United States Patent [19]

Wu et al.

[11] 4,104,034

[45] Aug. 1, 1978

[54] EASY LIGHTING FIREPLACE LOG

[75] Inventors: Kent Yengtsu Wu; Roger S. Barron, both of Stockton, Calif.

[73] Assignee: Duraflame, Inc., Stockton, Calif.

[21] Appl. No.: 793,947

[22] Filed: May 5, 1977

Related U.S. Application Data

[63] Continuation-in-part of Ser. No. 705,687, Jul. 15, 1976, abandoned.

[51] Int. Cl.[2] ..... C10L 5/00; C10L 11/00; C10L 5/14

[52] U.S. Cl. ..... 44/10 R; 44/24; 44/38; 44/40; 44/41

[58] Field of Search ..... 44/10 R, 38, 24, 40, 44/41

[56] References Cited

U.S. PATENT DOCUMENTS

| | | | |
|---|---|---|---|
| 2,789,890 | 4/1957 | Stevens | 44/41 |
| 3,726,651 | 4/1973 | Ronden | 44/10 R |
| 3,988,121 | 10/1976 | Leveskis | 44/41 |
| 4,043,765 | 8/1977 | Tanner | 44/40 X |

*Primary Examiner*—Carl Dees
*Attorney, Agent, or Firm*—Martin R. Horn

[57] ABSTRACT

An artificial fireplace log is formed with a groove in its surface extending axially along the length of the log. The log is provided with a paper wrapper having a flap, located near the upper limit of the groove, which flap extends outwardly from the log such that the flap can be easily ignited. On the inside surface of the paper wrapper directly opposite the location of the groove is placed a combustible material. This material extends along the length of the log and is of a width less than the width of the groove. By reason of the placement of the flap, groove and combustible material, the combustible material is easily ignited which in turn causes the log to become uniformly lighted over its length in a very short time.

13 Claims, 4 Drawing Figures

EASY LIGHTING FIREPLACE LOG

REFERENCES TO RELATED APPLICATIONS

This application is a Continuation-in-Part of copending application Ser. No. 705,687 filed on July 15, 1976, now abandoned.

BACKGROUND OF THE INVENTION

1. Field of the Invention

This invention relates to the field of manufacture of artificial fireplace logs, and more specifically to easy lighting artificial fireplace logs.

2. Description of the Prior Art

It is typical of prior art artificial fireplace logs that the time interval from ignition of the log to the time when the log is evenly burning along its length, is on the order of ten to fifteen minutes. Various methods have been used to shorten this time including (1) the use of a flap as discussed below; (2) placing newspaper which has been crumpled or formed into a spindle shape beneath the log and igniting the newspaper; and (3) the use of a groove which contains a "quick lighting" combustible material.

Examples of prior art easy lighting artificial fireplace logs include: L. A. Stevens, U.S. Pat. No. 2,789,890 filed Mar. 8, 1954 issued Apr. 23, 1957; C. P. Ronden, U.S. Pat. No. 3,726,651 filed Dec. 15, 1969 issued Apr. 10, 1973 and Leveskis, U.S. Pat. No. 3,988,121 filed Jan. 9, 1976 issued Oct. 26, 1976.

The artificial fireplace log of Stevens does not show the use of a groove to bring air into contact with a combustible material. Instead, it uses used crank case oil as combustible material and mixes the combustible material with the material used to form the bulk of the log. In contrast, the combustible material of the present invention is not applied to or mixed into the firelog. The combustible material of the device of Stevens is used to promote combustion of the log whereas the combustible material of the device of the present invention is used to achieve easy, rapid, and uniform ignition of the log.

The artificial fireplace log of Ronden shows the use of multiple grooves. However these grooves are used (see Column 4 line 24 to 30) merely to increase the surface area of the log and to provide the log with thin pointed ridges (13), as illustrated in FIG. 3 of Ronden, for easier ignition. The quick lighting combustible material is either sodium nitrate, potassium nitrate, or potassium chlorate which are subject to strict governmental regulations regarding labeling and safety precautions. They are strong oxidizers and are generally hazardous or toxic. They are such strong oxidizers that they do not require an additional external air supply for combustion. They supply their own oxygen for burning. In contrast with the device of the present invention, these oxidizers are mixed together with the material which in prior art fireplace logs is compacted to form the bulk of the log. These oxidizers are used to promote burning of the log, not merely its easy ignition.

The igniter pellet of Leveskis shows the use of a groove. However, the groove is not used as a passageway to supply oxygen, but rather is used merely as a recess into which is placed and retained by compaction a highy flammable and toxic peroxide-cellulosic powder (column 2, lines 11 to 15).

In order to achieve easier ignition Ronden and Leveskis have incorporated substances that are extremely hazardous in manufacturing, transport and end use. The nitrate used in Ronden's process is potentially explosive and the peroxide used in the Leveskis process is not only potentially explosive but highly toxic. Even with igniters incorporated into these two products neither product is designed to be ignited with a wrapper covering the product. Indeed neither product even shows the use of a wrapper. The device of the present invention is capable of being ignited while inside its warapper. However, the use of the wrapper is not required to practice the invention, it being only necessary to supply a means of supporting the combustible material adjacent the groove and spaced from the log. It is not necessary that the log be wrapped.

The prior art also teaches the use of a flap, integrally formed from the material used to wrap the fireplace log. However, prior art flaps were not oriented in any particular direction. All prior art flaps are directed away from the wrapper of the log, but whether the flap was directed away and up or away and down was of no importance. Also included in the prior art is an artificial fire log having a groove formed along its length in which is placed and retained a quantity of a mixture containing diesel fuel. The primary disadvantage of the diesel fuel is its low flash point of between 100° F and 190° F. These artificial fire logs are often shipped and stored in closed containers and subjected to somewhat elevated temperatures which presents an added danger of unintended ignition of the log.

The effectiveness of the flap as it has been conventionally employed is minimal, the crumpled paper is inconvenient, and the use of the diesel fuel (or strong oxidizers such as nitrates and peroxides) in a groove is dangerous.

It is therefore an object of the present invention to produce a firelog which overcomes these disadvantages. The purpose of the easy lighting feature of the present invention is to provide a safe, effective, clean and convenient method for igniting a synthetic firelog. In order to be safe, there must be no hazardous compounds employed. In order to be clean and convenient, the firelog should be able to be ignited without having to open the wrapper and without any form of kindling. In order to be effective, the firelog should become ignited across the full length of the log in a very short time. Of the three patents discussed above, no single patent, nor any combination thereof, can satisfy these requirements.

Even though some of the elements of the present invention are present in each of the three patents discussed, no combination of the three would produce a product that meets the criteria cited above. This is mainly because none of the prior art devices discussed includes a safe or effective combustible material, which is an essential feature of the present invention.

None of the above discussed prior art devices shows the use of a groove to cooperatively admit air (oxygen) to support combustion of an easy lighting combustible material which is placed on the inner surface of the wrapper of the log (rather than mixed into or placed on the log itself) and located directly adjacent to the groove. This specific and unique combination is the heart of this invention. Because the groove admits additional oxygen for combustion, the present invention can employ a less dangerous and more stable combustible material than the prior art devices.

SUMMARY OF THE INVENTION

The artificial fireplace log of the present invention consists of a log which is made of a mixture of wax and sawdust. The log has a groove running axially along the length of the log. Opposite the groove and on the inside of the wrapper of the log is applied the combustible material. The wrapper is folded so as to provide a flap just above and typically within ½ inch of the combustible material. For most effective utilization of this invention, the flap is directed away from the log and below the horizontal. The particular combustible material employed to produce the easy starting, even igniting characteristics of the log is a mixture of an aliphatic resin, paraffin wax, and a gelling agent. Preferably, the aliphatic resin is Piccopale 70 and the gelling agent is Cab-O-Sil (a fumed silicon dioxide). The mixture is made fluid by heating and may be sprayed, rolled or painted onto the interior surface of the wrapper of the log. The above described mixture has a flash point of between 390° F and 450° F. 390° F being the flash point of the paraffin and 450° F the flash point of the Piccopale 70. This embodiment of the invention is convenient for the consumer to use, easy lighting and even burning in a minimum time, and safe to store and transport.

The special relationship of the groove, combustible material and flap are important because it enables one to easily ignite a substance (the combustible material) which, by itself, is not easy to ignite. In order to achieve this, several conditions must be met. First, the combustible material must have an adequate supply of oxygen. After the flap of the present invention is ignited, the flame burns through the wrapper allowing air into the groove. The groove allows air to reach the inner surface of the wrapper where the combustible material is located. Second, if the combustible material is to burn, it must be provided with a "wick". Like the wax of a candle, the combustible material of the present invention is difficult to ignite by itself. If a flame is held near the combustible material alone, it will likely not ignite but rather will only melt. Like the wax of a candle, it requires a wick. The wrapper of the log of the present invention serves as a "wick" for the combustible material. Third, the combustible material must be allowed to reach its ignition temperature. This would be difficult if the combustible material was in contact with the firelog because, although the log has relatively poor heat transfer characteristics, enough heat could be transferred away from the combustible material to prevent it from reaching the ignition temperature. The air space provided by the groove prevents the combustible material from contacting the log. This allows the combustible material to reach its ignition temperature.

This unique interaction of the groove, wrapper and combustible material is believed to be the novelty of this invention.

BRIEF DESCRIPTION OF THE FIGURES

For a more complete understanding of the present invention and for further objects and advantages thereof, reference may now be had to the following description taken in conjunction with the accompanying figures in which.

DETAILED DESCRIPTION OF THE PREFERRED EMBODIMENT

Figure 1:
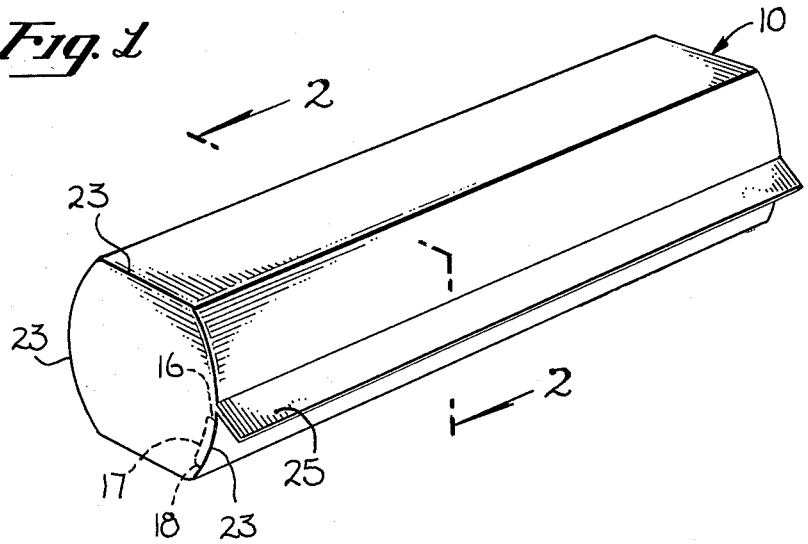
FIG. 1 is a perspective view of an artificial fire log according to the present invention.

The invention illustrated in FIG. 1 is a finished artificial fire log 10 which, by reason of the groove, flap and combustible material, is easy to light, convenient and safe to use, and produces an even flame over the length of the log in a minimum time.

Figure 2:
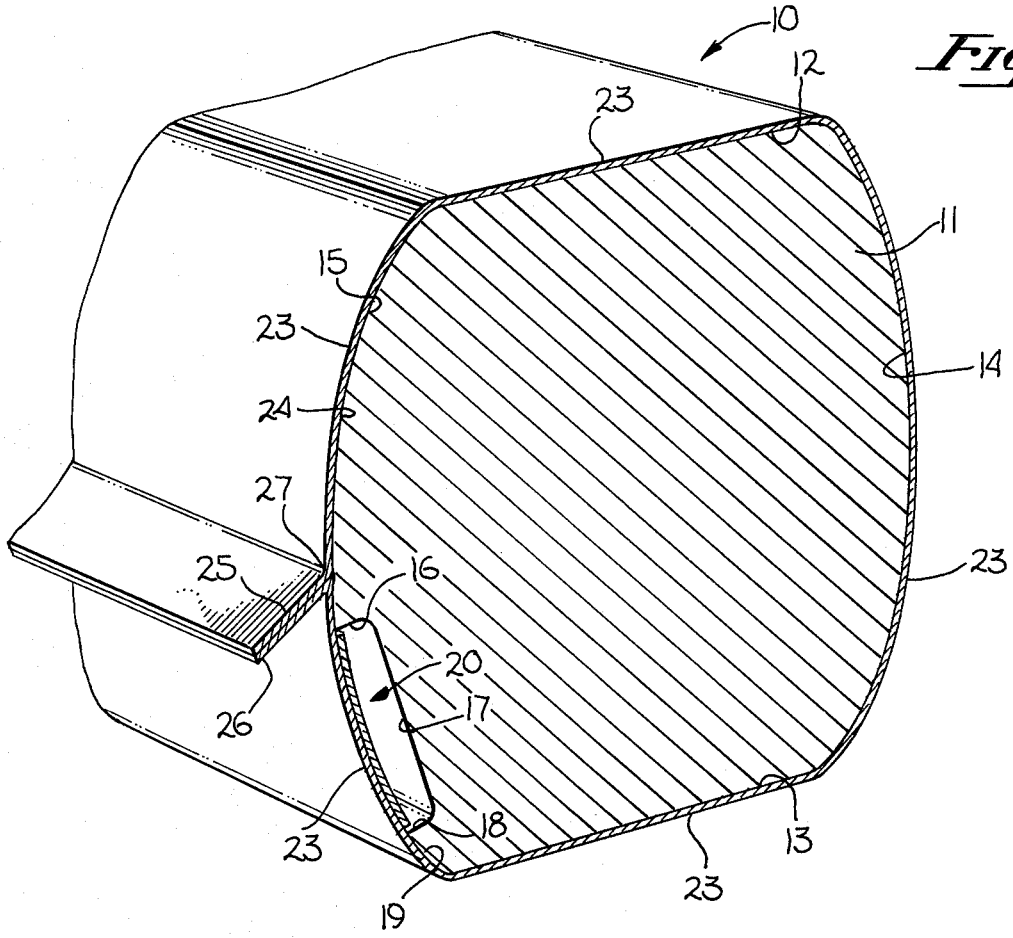
FIG. 2 is a cross-sectional view of the present invention, representative of the cross-section at any point along the length of the log.

The artificial fire log 11 as illustrated in FIG. 2 consists of a log shaped compaction of wood fiber such as sawdust and a bonding agent such as paraffin and microcrystalline waxes. The cross-sectional shape of the fire log resembles that of an ellipse having its ends flattened. The top 12 and bottom 13 of the cross-sectional view are flat, whereas the left and right sides are curved. The right side is shown as 14 in FIG. 2, the left side is formed by surfaces 15, 16, 17, 18 and 19. The distance between top 12 and bottom 13 is typically 4⅛ inches. Surfaces 16, 17, and 18 define a groove 20 in the left side of the invention as shown in FIG. 2. This groove 20 is typically below the centerline of the log and approximately 1¼ to 2 inches wide (distance from surface 16 to surface 18).

To the inside surface 24 of the wrapper 23 is applied a strip of a combustible material 21 which is a mixture of an aliphatic resin such as Piccopale 70, paraffin wax and Cab-O-Sil. Normally the ingredients are mixed before application. The wax and Piccopale 70 are mixed first, then the Cab-O-Sil is added. The combustible material 21 is heated causing the mixture to become fluid. No chemical reaction occurs, rather only a physical interaction. When the mixture is sufficiently liquid, it can be applied to the inner surface 24 of the wrapper 23 by painting, spraying or rolling. For best workability, and ease of application, the combustible material 21 is kept at a temperature of between 150° and 170° F. The mixture is applied to the inner surface 24 of the wrapper 23 so as not to extend above or below surfaces 16 and 18 respectively. Depending on the width of surface 17, the strip of combustible material may vary between ¾ and 1½ inches in width when applied. This leaves an air space 22, bounded generally by the surfaces 16, 17, 18 and the combustible material 21, which allows oxygen to flow along the length of the log to reach the combustible material 21 to support combustion.

The combustible material 21 consists of a mixture of an aliphatic resin, paraffin wax, and Cab-O-Sil. In the preferred embodiment, the aliphatic resin is Piccopale 70, Piccopale is a registered trade name of Hercules, Incorporated. Piccopale is manufactured from petroleum-derived monomers and available in three softening point grades, 70° to 100° C. Piccopale 70 has a softening point of 70° C, in solid form. Piccopale may be used in pressure sensitive adhesives, hot-melt adhesives and coatings, waterproofing agents, paints and varnishes, rubber compounding, paper saturation, and can coatings. Piccopale 70 has a flash point of 450° F.

The paraffin wax may be any wax that is not excessively tacky.

Any combustible resin can be substituted for the Piccopale as long as the flash point of the mixture of resin, wax, and Cab-O-Sil is 140° F or above. A product which exhibits properties similar to Piccopale 70 is sold by Exxon Chemicals under the trademark Escorez.

The Cab-O-Sil is a fumed silica powder. It is sold by the Cabot Corporation under that same trademark Cab-O-Sil. It serves as a gelling agent thus inhibiting the combustible material from dripping off the wrapper when ignited. This function could also be served by Syloid which is a product sold by Davison Chemical under the trademark Syloid. The Cab-O-Sil is not necessary to the combustible material but makes it more convenient to use and increases its effectiveness by inhibiting the dripping of the material. If the combustible material drips away from the wrapper, it loses its effectiveness since the wrapper can no longer serve as a wick.

The Piccopale 70 and paraffin wax are mixed in a proportion ranging from three parts by weight Piccopale 70 to seven parts by weight wax to a ratio of seven parts Piccopale 70 to three parts by weight of wax. To this mixture is then added three to ten percent by weight of Cab-O-Sil, making a total of 103 to 110 parts by weight. The Cab-O-Sil is preferably of the type designated MS5 or HS5.

As used in this invention, the term Cab-O-Sil is used to designate fumed silicon dioxide. It has an extremely small particle size and hence a very large surface area of $200 \pm 25$ $m^2$/gram. Cab-O-Sil exhibits chain-forming tendencies. The reaction for its formation is:

$$SiCl_4 + 2H_2 + O_2 \xrightarrow{1800^\circ C} SiO_2 + 4HCl$$

Other characteristics include:

specific gravity: 2.3
bulking value: 5.5 gal./100 lbs.
refraction index: 1.46
color: white
x-ray form: amorphous Piccopale 70 resin is an aliphatic thermoplastic hydrocarbon. It is produced by the polymerization of unsaturates derived from the high temperature cracking of petroleum. The unsaturates are composed of dienes and reactive olefins with an approximate molecular weight of 90. Piccopale resin is alkyl cyclic with no aromatic structures present. The average weight of the polymer is 1100. Piccopale is more particularly described in the Canadian Pat. No. 531202 issued to Alger Ward.

The mixture of Piccopale 70, wax and Cab-O-Sil forms the combustible material. This combustible material 21 is then placed, as described above, on the wrapper. In the preferred embodiment approximately three to five grams of the combustible material is applied to each wrapper. As little as 1 grams works satisfactorily in most instances. After the combustible material is placed on the wrapper 23 of the log 11, the entire log is covered by the paper wrapping 23 such that the combustible material 21 is directly opposite the groove 20.

Due to mechanical tolerances on the accuracy with which machinery can wrap the log, the exact location of the flap, with respect to the grooves is variable. Some logs may be wrapped such that the flap is slightly above the upper limit of the groove 20, others may be wrapped such that the flap is between the limits of the groove. In any event, the flap is above or adjacent to the upper limit of the combustible material.

This wrapping is done so as to form a flap 25 which extends away and downward from the log. The flap has one end 26 which when properly oriented for lighting is lower than the end 27, end 27 being above or adjacent the combustible material 21. The flap is from ¼ to 1 inch in length (the distance between end 26 and end 27). The physical location of the flap 25 with respect to the combustible material 21 and groove 20 is of great importance. The combustible material 21 should be located at or below the end 27 of flap 25 and opposite the groove 20, forming an air space 22 consisting of the groove 20 and combustible material 21. The paper wrapping 23 must be positioned on the log such that the flap 25 is near the upper surface of the groove 20 and sloping down and away from the log. It is desirable that the present invention is not ignited in the upside down position. In that orientation, the flap 25 is sloped above the horizontal, and it would possibly not ignite or would not ignite properly, and the log would not burn as designed.

Prior art fireplace logs take from five to fifteen minutes to produce an even flame along the length of the log. These logs do not have a groove, flap, or combustible material 21 oriented according to the present invention, and are ignited by placing crumpled newspaper beneath the log and lighting the newspaper. The log can be lighted faster by sliting the paper wrapper. When this is done the time is reduced to five to ten minutes. By use of the paper flap 25 and the groove 20 and combustible material 21, the log of the present invention is evenly lighted along its length in from two to five minutes. While the groove 20 of the preferred embodiment is shaped like a flattened U, the shape of the groove is a matter of esthetics only, and various shapes are intended to be within the scope of this invention, including semicircular, V shaped, and irregular shapes.

The special relationship of the groove, combustible material and flap are important because it enables one to easily ignite a substance (the combustible material) which, by itself, is not easy to ignite. In order to achieve this, several conditions must be met. First, the combustible material must have an adequate supply of oxygen. After the flap of the present invention is ignited, the flame burns through the wrapper allowing air into the groove. The groove allows air to reach the inner surface of the wrapper where the combustible material is located. Second, if the combustible material is to burn, it must be provided with a "wick". Like the wax of a candle, the combustible mixture of the present invention is difficult to ignite by itself. If a flame is held near the combustible material alone, it will likely not ignite but rather will only melt. Like the wax of a candle, it requires a wick. The wrapper of the log of the present invention serves as a "wick" for the combustible material. Third, the combustible material must be allowed to reach its ignition temperature. This would be difficult if the combustible material was in contact with the firelog because, although the log has relatively poor heat transfer characteristics, enough heat could be transferred away from the combustible material to prevent it from reaching the ignition temperature. The air space provided by the groove prevents the combustible material from contacting the log. This allows the combustible material to reach its ignition temperature.

Figure 3:
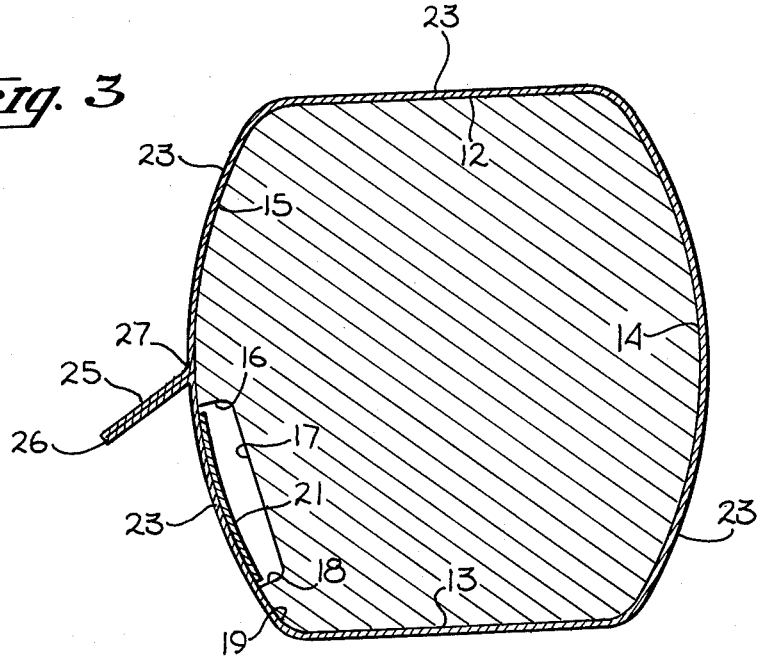
FIG. 3 is a cross-sectional view of a specific embodiment of the invention designed to burn for two to three hours.

The specific embodiment of the invention illustrated in FIG. 3 is designed to burn for 2 to 3 hours. The flap 25 has its upper end 27 located midway between the ends 12 and 13 and approximately ¼ inch from the surface 16. The distance between surfaces 12 and 13 being approximately 3½ inches. The groove is approximately 1¼ inches from surface 16 to surface 18 and 5/16 inch from surface 17 to the wrapper 23. The maximum distance from surface 15 to surface 14 (width of log) is approximately 3 3/16 inches. The radius of curvature of surfaces 15 and 14 is approximately 3 inches.

Figure 4:
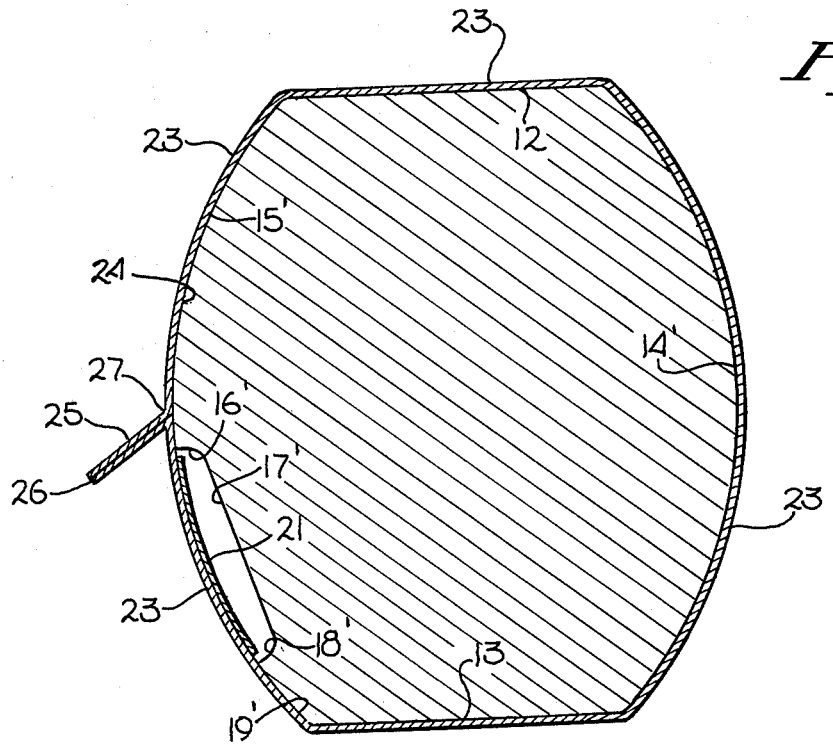
FIG. 4 is a cross-sectional view of a specific embodiment of the invention designed to burn a minimum of three hours.

The specific embodiment of the invention illustrated in FIG. 4 is designed to burn for a minimum of three hours. It is like the embodiment shown in FIG. 3 except the distance between surfaces 12 and 13 is approximately 4⅛ inches. The groove is approximately 1½ inches from surface 16' to surface 18', its width remains 5/16 inch. The maximum distrance from surface 15' to surface 14' (width of log) is approximately 3/16 inches. The radius of curvature of surfaces 15' and 14' is approximately 3 inches.

The combustible material for both embodiments illustrated in FIGS. 3 and 4 consists of from 1 to 5 grams by weight of Piccopale 70, and 50 parts by weight of paraffin wax.

The present invention thus produces an easy lighting artificial fireplace log that is safe and convenient to use. Various additional changes and modifications in the above described invention and the method of operation thereof will be readily apparent to one skilled in the art and such changes and modifications are deemed to be within the spirit and scope of the present invention as set forth in the following appended claims.

What is claimed is:

1. An artificial fireplace log comprising:
an artificial log;
a groove formed in the surface of the log;
an easily ignited combustible material, said material having a high flash point fuel;
a means for supporting said easily ignited combustible material out of contact with said artificial log and such that substantially all of said easily ignited combustible material is located below the upper extent of said groove and above the lower extent of said groove;
a means for igniting said easily ignited combustible material; and
said support means covering said groove, said easily ignited combustible material being bonded to the inside of said support means, facing said groove.

2. An artificial fireplace log comprising:
an artificial log;
an elongated groove formed in the surface of the log;
a wrapper which encloses the log;
an easily ignited combustible material supported entirely on the inside of said wrapper facing said groove, said wrapper serving as a wick for said combustible material, and
a means for igniting said easily ignited combustible material consisting of a flap on said wrapper extending outwardly from adjacent the portion of the wrapper supporting said combustible material.

3. An artificial fireplace log according to claim 1 wherein the support means is a portion of a wrapper enclosing said log and the igniting means is a flap which is an integral part of said wrapper and extends outwardly from adjacent said wrapper support means portion.

4. An artificial fireplace log according to claim 1 wherein the groove runs axially along the full length of the log.

5. An artificial fireplace log according to claim 4 wherein the groove is located on a side of the log and below the midpoint of the log.

6. An artificial fireplace log according to claim 5 wherein the support means and the combustible material extend the full length of the log.

7. An artificial fireplace log comprising an artificial log;
a groove formed in the surface of the log and extending axially along the full length of the log;
a wrapper enclosing the log;
an easily ignited combustible material including a high flash point fuel bonded to the inside of the wrapper opposite the groove and supported by said wrapper substantially out of contact with said artificial log, said wrapper also functioning as a wick for said combustible material; and
a flap integrally formed from the wrapper and positioned adjacent the combustible material, on the outside of the wrapper, said flap, wrapper and groove cooperating to facilitate easy ignition of said combustible material.

8. An artificial fireplace log according to claim 7 wherein the flap extends away from the log at an angle between 0° and 90° below the horizontal.

9. An artificial fireplace log according to claim 7 wherein the combustible material is a mixture of an aliphatic resin, a wax and gelling agent.

10. An artificial fireplace log according to claim 9 wherein the amount of combustible material applied to the inside of the wrapper is between 1 and 5 grams.

11. An artificial fireplace log according to claim 9 wherein said combustible material has a flash point above about 390° F.

12. An artificial fireplace log assembly comprising:
an artificial fireplace log consisting substantially of comminuted cellulosic material and a wax bonding agent,
an elongated groove in said log,
a wrapper covering said log,
a layer of combustible material disposed on said wrapper facing said groove and substantially out of contact with said log, said material comprising a high flash point resin, a gelling agent for inhibiting the combustible material from dripping off the wrapper when ignited and a wax binder, said wrapper functioning as a wick for said combustible material, and
an elongated flap on the outside of said wrapper, said flap terminating adjacent an edge of said groove,
whereby when said flap is ignited, the flame will burn through said wrapper to admit air into said groove, thereby providing sufficient oxygen to support ignition of said combustible material, the separation of said combustible material from said log preventing heat transfer away from said combustible material into said log so that said high flash point resin will be ignited by the burning flap and wicking action of said wrapper.

13. An artificial fireplace log assembly according to claim 12 wherein said wrapper is paper, and wherein said flap slopes outwardly and downwardly from adjacent the upper edge of said groove.

* * * * *